US008376172B2

(12) United States Patent
Allen, Jr.

(10) Patent No.: US 8,376,172 B2
(45) Date of Patent: Feb. 19, 2013

(54) CONTAINER LID GASKET PROTECTIVE STRIP FOR DOUBLE DOOR TRANSFER SYSTEM

(75) Inventor: Burgess M. Allen, Jr., Aiken, SC (US)

(73) Assignee: Savannah River Nuclear Solutions, LLC, Aiken, SC (US)

( * ) Notice: Subject to any disclaimer, the term of this patent is extended or adjusted under 35 U.S.C. 154(b) by 546 days.

(21) Appl. No.: 12/380,330

(22) Filed: Feb. 26, 2009

(65) Prior Publication Data

US 2009/0212054 A1 Aug. 27, 2009

Related U.S. Application Data

(60) Provisional application No. 61/067,296, filed on Feb. 26, 2008.

(51) Int. Cl.
*B65D 51/18* (2006.01)

(52) U.S. Cl. ..... 220/254.1; 220/359.3; 220/352.2; 220/359.1; 220/254.2; 215/232

(58) Field of Classification Search ..... 220/359.3, 220/352.2, 359.1, 254.2, 254.1, FOR. 186, 220/FOR. 203; 215/232
See application file for complete search history.

(56) References Cited

U.S. PATENT DOCUMENTS

| | | | | |
|---|---|---|---|---|
| 3,391,847 | A * | 7/1968 | Christine et al. | 229/123.1 |
| 3,743,617 | A * | 7/1973 | Kest | 524/274 |
| 4,619,572 | A | 10/1986 | Lorenzeli et al. | |
| 4,937,628 | A * | 6/1990 | Cipolla et al. | 399/106 |
| 5,611,452 | A * | 3/1997 | Bonora et al. | 220/378 |
| 6,308,749 | B1 | 10/2001 | Brossard et al. | |
| 7,448,184 | B2 * | 11/2008 | Clark et al. | 53/453 |
| 7,469,788 | B2 * | 12/2008 | Chiu et al. | 206/710 |
| 2006/0124578 | A1 * | 6/2006 | Yousif et al. | 215/347 |
| 2008/0017646 | A1 * | 1/2008 | Baird-Smith et al. | 220/361 |

FOREIGN PATENT DOCUMENTS

| | | |
|---|---|---|
| EP | 0 586 307 B1 | 1/1997 |
| EP | 1 615 750 B1 | 12/2007 |
| GB | 2 237 816 | 5/1991 |
| GB | 2 326 369 | 12/1998 |

* cited by examiner

*Primary Examiner* — J. Gregory Pickett
*Assistant Examiner* — Blaine Neway
(74) *Attorney, Agent, or Firm* — J. Bennett Mullinax, LLC

(57) ABSTRACT

An apparatus and a process for forming a protective barrier seal along a "ring of concern" of a transfer container used with double door systems is provided. A protective substrate is supplied between a "ring of concern" and a safety cover in which an adhesive layer of the substrate engages the "ring of concern". A compressive foam strip along an opposite side of the substrate engages a safety cover such that a compressive force is maintained between the "ring of concern" and the adhesive layer of the substrate.

3 Claims, 3 Drawing Sheets

CONTAINER LID GASKET PROTECTIVE STRIP FOR DOUBLE DOOR TRANSFER SYSTEM

RELATED APPLICATIONS

This application claims the benefit of U.S. Application Ser. No. 61/06,296 filed on Feb. 26, 2008, and which is incorporated herein by reference.

STATEMENT AS TO RIGHTS TO INVENTIONS MADE UNDER FEDERALLY SPONSORED RESEARCH AND DEVELOPMENT

This invention was made with Government support under Contract No. DE-AC0996-SR18500 awarded by the United States Department of Energy. The Government has certain rights in the invention.

FIELD OF THE INVENTION

This invention relates to an apparatus and a process related to double door transfer systems used to transport hazardous material into and out of a glovebox without breaching the integrity of the glovebox internal environment or the container. The apparatus and process uses an adhesive substrate with a foam gasket to secure the lid and ensure the contaminated gasket surface area of the container used with a double door transfer system is sealed and secure.

BACKGROUND OF THE INVENTION

The transfer materials into, and products out of, a glovebox/isolator may be achieved using a double door transfer system. Such systems are known in the art as double door transfer ports, rapid transfer ports, alpha-beta transfer ports or double port transfer exchanges commercially available from numerous manufacturers. Canisters are used to transport hazardous and/or sterile material from one containment enclosure to another. The container is "docked" within a from one containment enclosure to another. The container is "docked" within a port in a sealed fashion and then from within the glovebox the port door is opened. Re-docking of the container to the port may be accomplished using, for instance, a bayonet system in which the container is twisted about its axis to dock into place at the port.

The transfer container has an exposed gasket sealing surface which is known in the art as the "ring of concern". This "ring of concern" has the potential for transfer of contamination outside the confines of the container. When the container is used to house a powder or similar material, the risk of contamination is increased by the ease in which the powder may be displaced and agitated during transport or storage Radioactive/Toxic contaminants, particularly alpha-emitting radiation sources, are of particular concern in a double door device. The energy level of alpha-emitting contaminants is sufficiently strong that radioactive particles can migrate or "bounce" and can easily spread along a surface. Accordingly, there remains interest in providing an apparatus and process which prevents the spread of radioactive materials which may be handled through a double door device.

One approach in the art to address the "ring of concern" is to use built in heat or UV sterilizing systems to prevent biological contamination of the "ring of concern". Other systems require cleaning and sterilization protocols for non-biological material which may adhere to the "ring of concern". While such approaches are useful in specialized applications, there remains a need which minimizes the possibility in which contamination will escape from the contaminated "ring of concern" gasket area. Accordingly, there remains room for variation and improvement within the art.

SUMMARY OF THE INVENTION

It is one aspect of at least one of the present embodiments to provide for a covering which engages the "ring of concern" region via a gasket with an adhesive overlay.

It is a further aspect of at least one of the present embodiments of the invention to provide for an adhesive paper layer to be positioned opposite a gasket of a double door device, the adhesive layer held in place by the compressive force of a container lid safety cover pressed against a foam ring on one side of the adhesive layer.

It is still a further object of at least one aspect of the present invention to provide for a process of preventing contamination from a "ring of concern" of a container flange which comprises the steps of positioning a substrate layer opposite the "ring of concern" of a container, the paper layer having an adhesive layer positioned between the "ring of concern" and the substrate layer; thereafter compressing a foam layer on an opposite side of the substrate layer such that the foam layer is compressed and forces the adhesive portion of the substrate to be in intimate contact with the "ring of concern".

It is yet a further aspect of at least one embodiment of the present invention to provide for a containment strip to be used with a double door device container lid in which the containment strip has a first surface, a foam layer, and a second surface which defines an adhesive layer, the foam surface adapted for compression of the adhesive substrate surface by placing the adhesive layer in operative engagement with the "ring of concern" of the container It is yet a further aspect of at least one embodiment of the present invention to provide for an applicator tool adapted for receiving a containment strip, the applicator tool having an alignment guide for placement of the containment strip in proper orientation onto the "ring of concern" of a double door container lid.

It is yet a further aspect of at least on embodiment of the present invention to provide for an apparatus and a process for preventing the spread of contamination from a transfer container used with a double door system comprising: removing a container from a double door apparatus; applying to an upper surface of the container a substrate, an adhesive applied to a first surface of the substrate and a foam strip applied to a second surface of the substrate, the foam strip conforming generally to the size and shape of a gasket carried by the container; applying the substrate to the upper container surface thereby positioning an adhesive side of the substrate to the gasket and the container lid of the container; and, engaging the container lid with a safety cover, the safety cover compressing the foam strip thereby maintaining a pressure engagement of the paper substrate and the adhesive layer against the gasket and the portion of the container surrounding the gasket.

It is a further aspect of at least one embodiment of the present invention to provide for a sealed double door transfer container comprising: a lid, a bottom, and a sidewall defining a volume therein; a gasket, positioned within a groove associated with an opening to the container; a container lid positioned on top of the container and engaging at least a portion of the gasket; a substrate applied to the opening of the container, the substrate having an adhesive layer engaging the container lid and the gasket, the substrate further defining a foam strip on an upper surface of the substrate, the foam strip conforming generally to the shape and dimensions of the gasket; and, a safety cover applied over the opening of the container, the safety cover compressing the foam strip in a region opposite the gasket, thereby providing a compressive force to the adhesive substrate in proximity to the gasket.

It is yet a further aspect of at least one embodiment of the present invention to provide for a containment seal for a transfer container comprising: a substantially flat substrate layer having dimensions adapted for a lid of a transfer container; an adhesive layer applied to at least a portion of a lower surface of the substrate; and, a compressible foam layer applied to an upper surface of the substrate, the foam layer corresponding to the shape and dimensions of a gasket carried by an upper surface of a transfer container, the compressible foam layer further adapted for engaging an inner surface of a safety cover such that when the safety cover is applied to the transfer container, the compressible foam layer is compressed, thereby maintaining pressure between the adhesive layer and a gasket carried on a transfer container lid.

These and other features, aspects, and advantages of the present invention will become better understood with reference to the following description and appended claims.

BRIEF DESCRIPTION OF THE DRAWINGS

A fully enabling disclosure of the present invention, including the best mode thereof to one of ordinary skill in the art, is set forth more particularly in the remainder of the specification, including reference to the accompanying drawings.

DESCRIPTION OF THE PREFERRED EMBODIMENT

Figure 1:
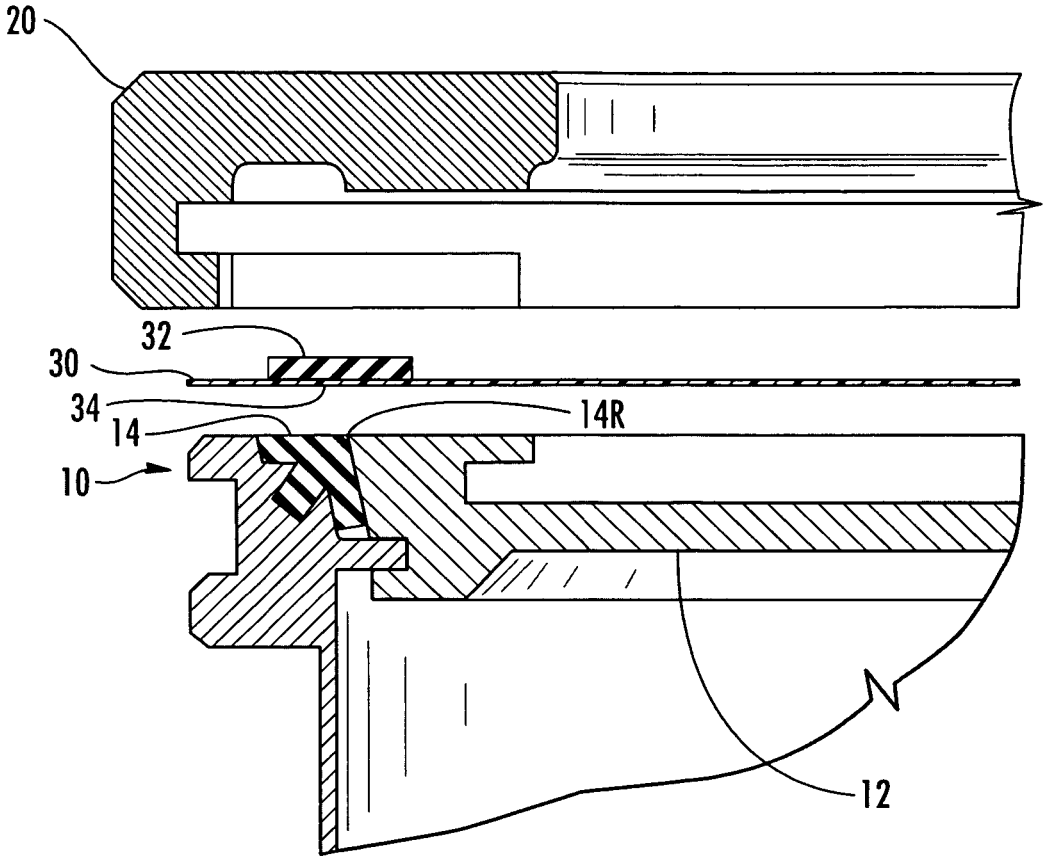
FIG. 1 is sectional exploded view of a double port transfer exchange container lid showing placement of a contaminant adhesive strip in relation to a safety cover.

Reference will now be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents. Other objects, features, and aspects of the present invention are disclosed in the following detailed description. It is to be understood by one of ordinary skill in the art that the present discussion is a description of exemplary embodiments only and is not intended as limiting the broader aspects of the present invention, which broader aspects are embodied in the exemplary constructions.

In describing the various figures herein, the same reference numbers are used throughout to describe the same material, apparatus, or process pathway. To avoid redundancy, detailed descriptions of much of the apparatus once described in relation to a figure is not repeated in the descriptions of subsequent figures, although such apparatus or process is labeled with the same reference numbers.

There exists a variety of double port transfer exchange apparatuses including glove boxes and containers. Such transfer systems are commonly utilized in the pharmaceutical, biotechnology industry, and the commercial and government nuclear programs.

Representative variations of the double port transfer exchange may be seen in reference to U.S. Pat. No. 6,308,749 (L A Calhene), GB published application 2,237,816 A (Cambridge Isolation Technology, Ltd.), UK patent application 2,326,369 A (AEA Technology PLC), U.S. Pat. No. 4,619,572 (Cogela), European patent EP0586307 B1, and EP1615750 A1 for which the above referenced specifications and drawings are hereby incorporated herein by reference.

As best seen in reference to FIGS. 1, 2, 5 and 6, a double door container 10 is illustrated. Associated with container 10 is a safety cover 20 which is provided for container 10. However, safety cover 20 provides no additional sealing function but only offers physical protection of the container lid and prevents the lid from rotating from the container and becoming loose. Adjacent the double door container 10 and the container lid 12 is a gasket 14. The inner surface of gasket 14 defines a region 14R known in the industry as the "ring of concern". The ROC is along the inner gasket surface where the gasket makes contact with the container lid 12. In operation, container lid 12 is removed during a double port transfer step, exposing the gasket to possible contaminants.

The "ring of concern" (ROC) 14R is a location where there is the potential for contamination transfer to the container lid 12. An aspect of Applicant's present invention is to provide a containment adhesive strip 30 having an adhesive backing that will situate the strip on the upper surface of container 10, gasket 14, and container lid 12. In this manner, containment strip 30 provides a physical barrier which engages the upper surfaces of gasket 14, container 10, and lid 12. Further, to the extent loose particles such as a powder may be present from the ROC surface of gasket 14, the adhesive surface of the strip will serve to bind any loose particles that may be present on the ROC or that could be dislodged or transferred to the ROC from adjacent surfaces. Strip 30 may be provided from paper, mylar, plastic, or other flexible substrates which will support application of an adhesive layer.

Figure 2:
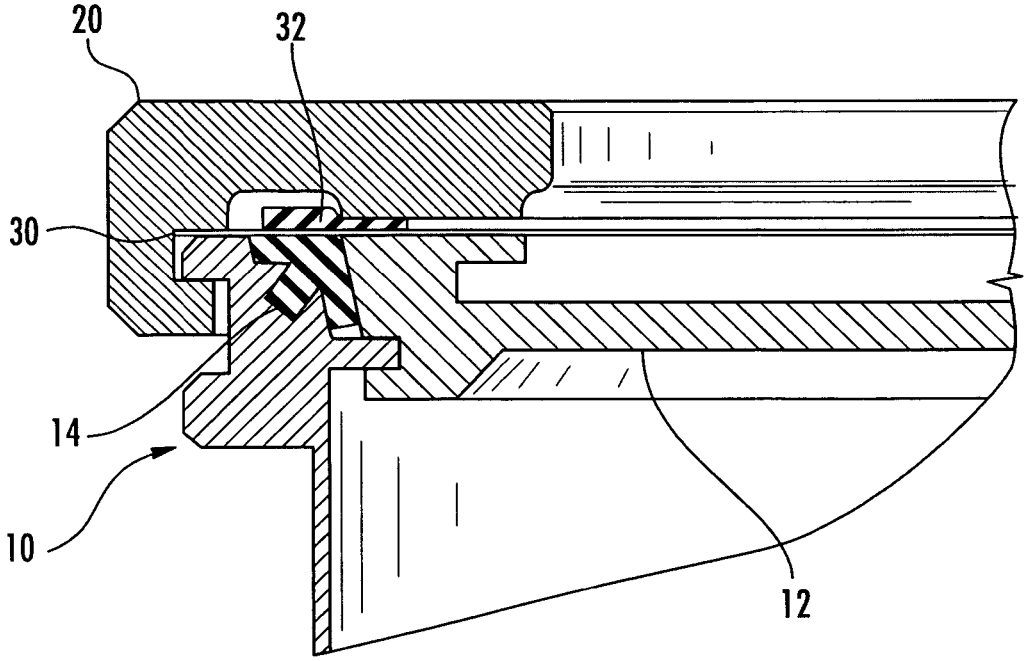
FIG. 2 is a view similar to FIG. 1 showing the component parts of a container lid, a containment adhesive strip, and safety cover when in an interengaged position.
Figure 3:
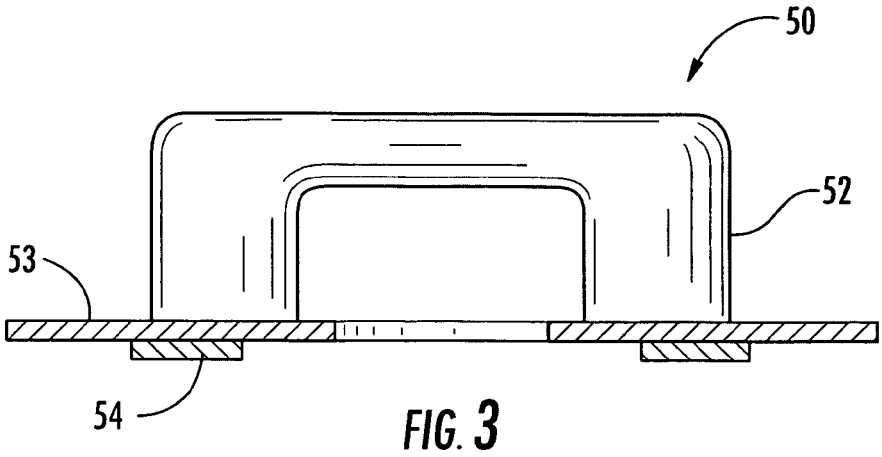
FIG. 3 is an applicator ring and handle which may be used to apply a containment adhesive strip to a double door device container lid.

As best seen in reference to FIG. 2, containment strip 30 also defines a raised perimeter of a closed cell foam strip 32, foam strip 32 is designed to interengage with cover 20 such that a compressive force is applied between cover 20 and the adhesive backing in the region of the gasket 14 and ROC 14R. The compressive force serves to maintain the adhesive backing of containment strip 30 in a pressure relationship with the gasket surface. The gasket surface typically is lubricated with a material such as silicon oil which would prevent direct adhesion of the strip to the ROC. The use of the foam strip 32 ensures a tight fit between the "ring of concern" and the indicated lower adhesive surface 34 of the containment strip 30.

The containment strip 30 may be formed of a variety of different substrates including paper, films, elastomeric materials, and other sufficiently flexible and pliable materials to which an adhesive layer may be applied to one surface. While a paper substrate is envisioned for its low cost and ease of disposal, other materials would suffice. If desired, the substrate may be provided in suitable colors or with industry standard warnings preprinted to reference possible contaminants such as radiation or biohazards.

Figure 4:
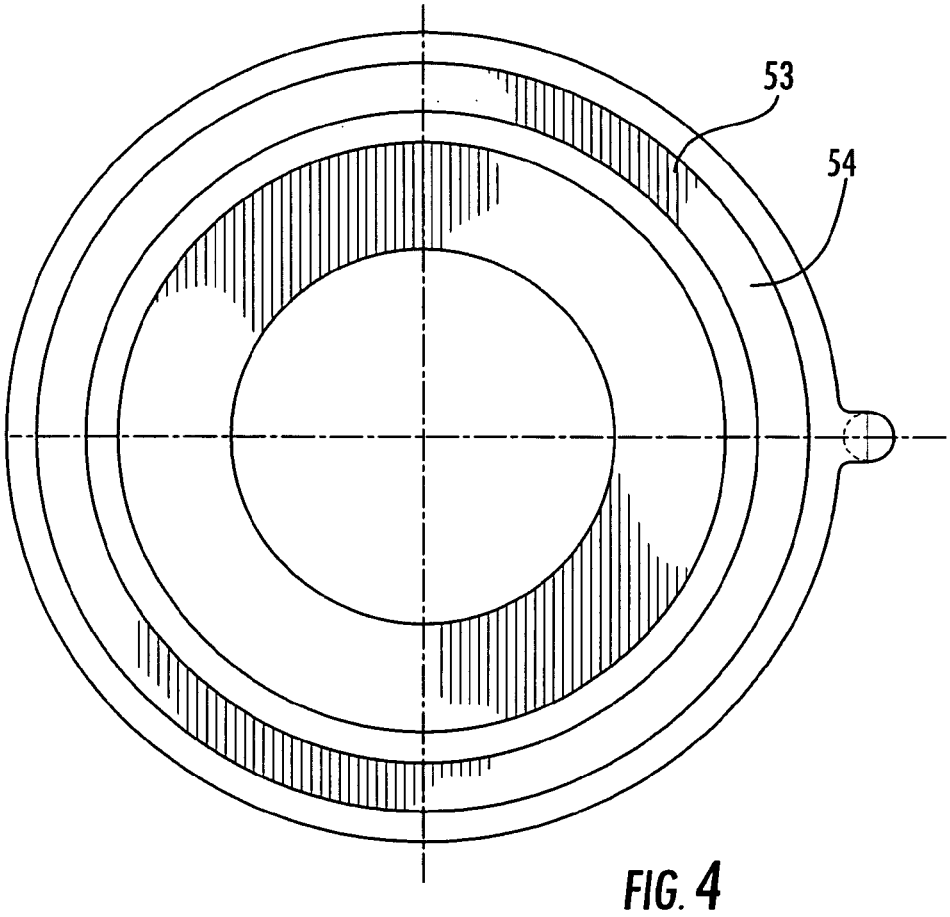
FIG. 4 is a bottom view of the circular ring of a closed cell foam positioned on an adhesive paper backing.
Figure 5:
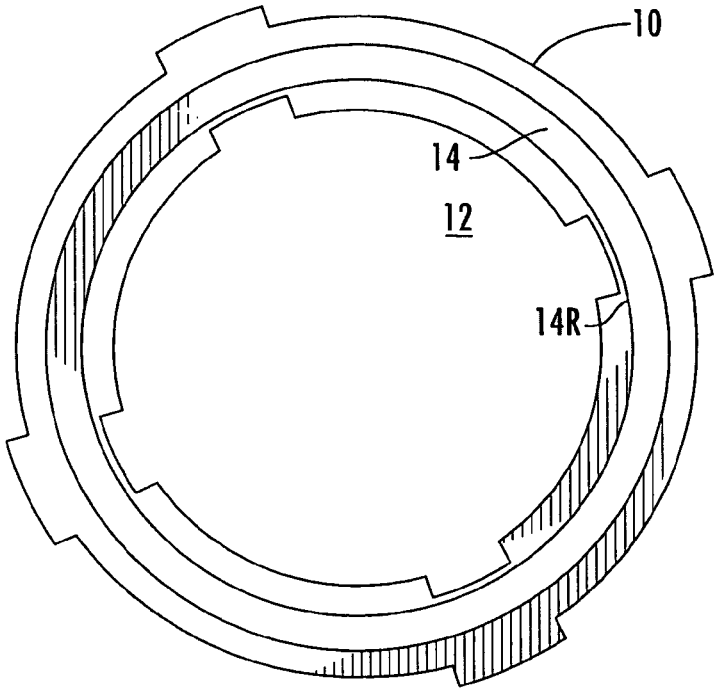
FIG. 5 is a plan view of the opening of a double port transfer exchange container illustrating the gasket in relation to the container lid and the ring of concern.
Figure 6:
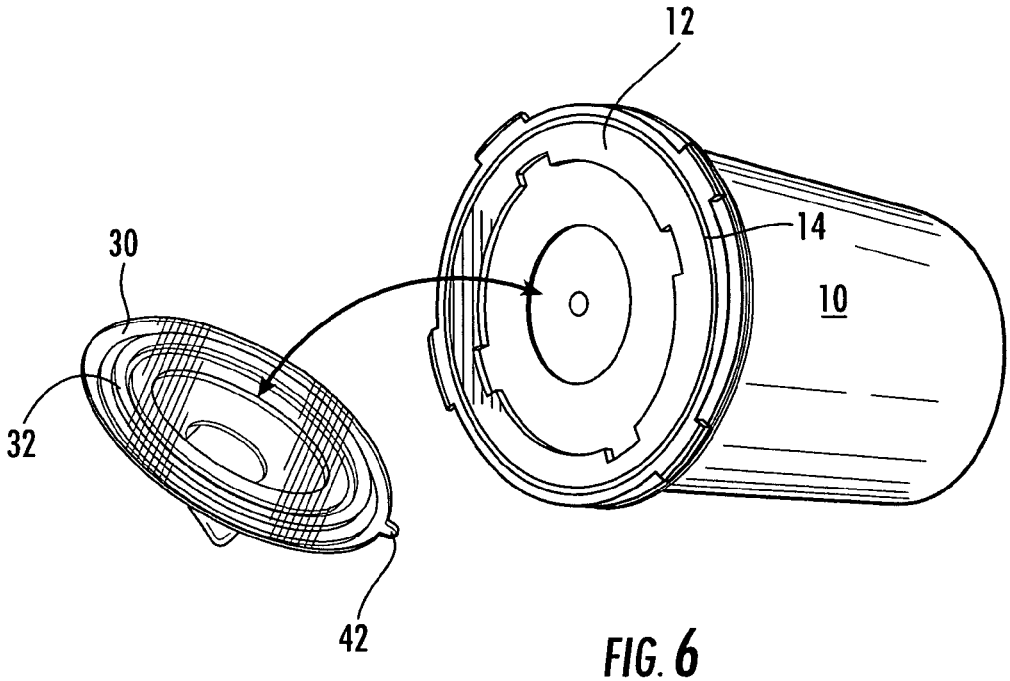
FIG. 6 is an exploded perspective view showing the interrelationship of a double door container in relation to a foam-backed contaminant adhesive strip being applied to the gasket and container opening of the double door container.

While the size and shape of a ROC may vary from manufacturer to manufacturer, for the purpose of illustration, the ROC is depicted in the current example in reference to a circular gasket. Accordingly, a circular piece of compressible foam is required to be situated over the "ring of concern". To accomplish this task, a paper label having a paper covered adhesive side and a non-adhesive side is used as a template for the containment adhesive strip. The compressible foam strip 32 has an adhesive surface which is applied to a non-adhesive side of the paper label 40 as seen in reference to FIG. 4. The adhesive label 40 has a tab 42 to facilitate removal of the protective paper backing from the label 40. As seen, a foam strip material 32 may be applied in the desired pattern onto the surface of the non-adhesive side of the paper ring.

It has been found useful to use a hand-held applicator 50 having a handle 52, a flat applicator surface 53, and an alignment ring 54. The containment strip 30 is attached to the applicator 50 using small strips of double backed adhesive tape such that the foam strip 32 is lightly adhered with the bottom of the applicator.

The tab 42 is acuated to remove the backing from the adhesive paper label 40. The applicator 50 is then centered over the container lid and the applicator is lowered and compressed until the adhesive backing of surface 34 adheres to the container opening. As the applicator 50 is slowly pulled away, the adhesive label remains on the surface of the double door container, gasket, and lid 12. When the safety cover is then applied to the lid, the cover presses foam strip 32 such that the compressive force is applied to the ROC, securing containment strip 30 and adhesive surface 34 to the upper surface of lid 12, including the ROC 14R.

When the container 10 is ready to be engaged with a double door device, the containment strip 30 may be peeled away and disposed of. To the extent contaminants may have been present along the "ring of concern", such contaminants, particularly those of a powder or particulate nature, would be adhered to the adhesive portion 34 of the containment strip 30. Further, positioning of the containment strip 30 over the "ring of concern" 14R prevents additional sources of contamination from reaching the gasket.

Further, use of the applicator allows pre-positioning of the containment strip 30 to facilitate application onto the "ring of concern". The applicator 50 allows for easier placement of the containment strip, particularly in a glove box or similar environment where protective gear makes manual manipulation of the component parts and paper labels more challenging. Following application of the containment adhesive strip, the strip may be removed as needed and is intended for single use.

Although preferred embodiments of the invention have been described using specific terms, devices, and methods, such description is for illustrative purposes only. The words used are words of description rather than of limitation. It is to be understood that changes and variations may be made by those of ordinary skill in the art without departing from the spirit or the scope of the present invention which is set forth in the following claims. In addition, it should be understood that aspects of the various embodiments may be interchanged, both in whole, or in part. Therefore, the spirit and scope of the appended claims should not be limited to the description of the preferred versions contained therein.

That which is claimed:

1. A sealed double door transfer container comprising:

a lid, a bottom, and a sidewall defining a volume therein;

a gasket, positioned within a groove associated with an opening to said container and said lid positioned on top of said container and engaging at least a portion of said gasket;

a substrate applied to said opening of said container, said substrate having an adhesive layer engaging the gasket, said adhesive layer adapted for retaining thereon particulate contaminants, said substrate further defining a foam strip on an upper surface of said substrate, said foam strip conforming generally to the shape and dimensions of said gasket; and, a safety cover applied over said opening of said container, said safety cover compressing said foam strip in a region opposite said gasket, thereby providing a compressive force to said adhesive substrate in proximity to said gasket.

2. The container according to claim 1 wherein said adhesive layer is further adapted for retaining alpha-emitting particles.

3. A sealed double door transfer container comprising:

a lid, a bottom, and a sidewall defining a volume therein;

a gasket, positioned within a groove associated with an opening to said container and said lid positioned on top of said container and engaging at least a portion of said gasket;

a disposable, single use substrate applied to said opening of said container, said substrate having an adhesive layer engaging the gasket, said adhesive layer adapted for retaining thereon particulate contaminants, said substrate further defining a foam strip on an upper surface of said substrate, said foam strip conforming generally to the shape and dimensions of said gasket; and, a safety cover applied over said opening of said container, said safety cover compressing said foam strip in a region opposite said gasket, thereby providing a compressive force to said adhesive substrate in proximity to said gasket.

* * * * *